US008928548B2

(12) United States Patent
Harel et al.

(10) Patent No.: US 8,928,548 B2
(45) Date of Patent: Jan. 6, 2015

(54) CHOKE REFLECTOR ANTENNA

(75) Inventors: Jean-Pierre Harel, Lannion (FR); Warren F. Hunt, Meriden, CT (US); Patrick Lecam, Lannion (FR); Marco Kunze, Hamburg (DE); Jérome Plet, Lannion (FR); Xiao Yun (Selina) Qu, Nanjing (CN)

(73) Assignee: Alcatel Lucent, Boulogne-Billancourt (FR)

( * ) Notice: Subject to any disclaimer, the term of this patent is extended or adjusted under 35 U.S.C. 154(b) by 578 days.

(21) Appl. No.: 12/266,234

(22) Filed: Nov. 6, 2008

(65) Prior Publication Data

US 2010/0013729 A1 Jan. 21, 2010

(30) Foreign Application Priority Data

Nov. 7, 2007 (FR) ..... 07 58847

(51) Int. Cl.
*H01Q 19/10* (2006.01)
*H01Q 1/24* (2006.01)
*H01Q 21/08* (2006.01)

(52) U.S. Cl.
CPC ..... *H01Q 1/246* (2013.01); *H01Q 19/106* (2013.01); *H01Q 21/08* (2013.01)
USPC ..... 343/837; 343/797

(58) Field of Classification Search
CPC ..... H01Q 1/246; H01Q 21/08; H01Q 19/106
USPC ..... 343/837, 810, 797, 834
See application file for complete search history.

(56) References Cited

U.S. PATENT DOCUMENTS

| | | | | |
|---|---|---|---|---|
| 6,025,798 | A | 2/2000 | Colombel et al. | |
| 6,067,053 | A * | 5/2000 | Runyon et al. | 343/797 |
| 6,295,028 | B1 * | 9/2001 | Jonsson et al. | 343/700 MS |
| 6,414,636 | B1 * | 7/2002 | Godard et al. | 343/700 MS |
| 7,443,356 | B2 * | 10/2008 | Roberts et al. | 343/797 |
| 2005/0179610 | A1 * | 8/2005 | Le et al. | 343/797 |
| 2010/0214190 | A1 * | 8/2010 | Shin et al. | 343/834 |

FOREIGN PATENT DOCUMENTS

| | | |
|---|---|---|
| EP | 0 973 231 A2 | 1/2000 |
| WO | WO 00/01032 | 1/2000 |

* cited by examiner

*Primary Examiner* — Hoanganh Le
(74) *Attorney, Agent, or Firm* — Fay Sharpe LLP

(57) ABSTRACT

An antenna comprising a network of arrayed radiating elements, a first reflective means comprising a flat central part upon which are disposed the radiating elements and longitudinally folded edges on either side of the array of elements, and at least one second reflective means which is a choke reflector disposed outside of the space separating the radiating elements of the reflector's folded edge. The second reflective means is separated from the first reflective means by a layer of dielectric material in order to connect it to the first reflective means by way of capacitive coupling.

5 Claims, 4 Drawing Sheets

CHOKE REFLECTOR ANTENNA

CROSS-REFERENCE TO RELATED APPLICATIONS

This application is based on French Patent Application #07 58 847 filed on Nov. 7, 2007, the disclosure of which is hereby incorporated by reference thereto in its entirety, and the priority of which is hereby claimed under 35 U.S.C. §119.

BACKGROUND OF THE INVENTION

1. Field of the Invention

This invention pertains to a telecommunication antenna, particularly one used for base stations of cellular communication networks (including GSM and UMTs networks). Such an antenna is made up of radiating element network spaced slightly apart. The invention particularly pertains to the reflecting means with which this antenna is equipped.

2. Description of the Prior Art

A telecommunications antenna sends and receives radio waves over frequencies specific to a telecommunications system used by that antenna. Thus, an antenna intended for the UMTS system uses waves whose frequencies are within the range of 1710 to 2170 MHz. A base station comprises a network of antennas, and supplies each antenna with waves whose frequencies are within the range that the antenna uses. However, the distance between the antennas is short, and as a result, every antenna has an influence on the adjacent antenna.

The document U.S. Pat. No. 5,710,569 mentions the problem of minimizing the lateral radiation of an antenna, a source of interference with neighboring antennas, by modifying the width of the horizontal beam and improving the front-to-back ratio. This document describes an antenna comprising arrayed dipoles attached to the flat base of a reflector whose edges fold upward. Choke reflectors are disposed within the area between the dipole and the lateral upward fold of the reflector, which they are distinct from, in such a way as to serve as a screen on other side of the row of dipoles. These choke reflectors are made up of metal sheets folded into L shapes and attached to the flat base of the reflector supporting the dipoles. They may move in a horizontal direction, so that they move closer to or further from the dipole array, in order to modify the characteristics of the antenna.

The document EP-0 973 231 states its purposes as minimizing the lateral lobes of an antenna, which are a source of interference with adjacent lobes, and to obtain the characteristics of a bipolarization with just one antenna. This document also mentions the possibility of controlling the isolation by adjusting the positions of the choke reflectors. This document describes an antenna comprising radiating elements attached to the flat part of a reflector comprising downward-folding edges. Two choke reflectors which may move longitudinally are disposed along the radiating elements on the flat part of the reflector. Transversal choke reflectors, furthermore, are placed between the radiating elements, perpendicular to the lateral choke reflectors.

In these documents, the term "choke reflector" refers to simple angle pieces which form two parallel flat surfaces which surround the arrayed radiating elements as closely as possible. The purpose of these choke reflectors is to modify the beam width value of the antenna. The authors of these documents have sought after a way to control the rated beam width value of the antenna by disposing the choke reflectors within the central area of the antenna, as close as possible to the dipoles.

SUMMARY OF THE INVENTION

The purpose of the invention is to improve the stability of a radio antenna's beam width along the horizontal plane.

A further purpose is to improve the performance of this antenna in cross-polarization along the main axis and along an axis of ±60° from the antenna.

The object of the invention is an antenna comprising a network of arrayed radiating elements, a first reflecting means comprising a flat central part upon which are disposed the radiating elements and longitudinally folded edges on either side of the arrangement of elements, and at least one second reflective means.

According to the invention, the second reflective means is a choke reflector disposed on the outside of the space separating the radiating elements from the folded edge of the first reflective means, and it is separate from the first reflective means by a layer of dielectric material so that it can be connected to the first reflective means by capacitive coupling.

According to the invention, the second reflective means is disposed outside the folded edges of the first reflective means of the antenna, outside the immediate radiating area of the elements, which, as a result, produces the stabilization of the beam width value of the antenna, and at the same time, simultaneously improves the cross-polarization parameters.

The second reflective means, according to the invention, is connected to the first reflective means by indirect electrical coupling or capacitive coupling. This represents an improvement upon the prior art: it is simply to assemble and poses no intermodulation problems resulting from improper assembly between parts. To achieve this, the second reflective means is separate from the first reflective means by a layer of dielectric material. Thus, the grounded parts are not in direct contact.

Unlike known devices, the inventive choke reflector does not affect the rated beam width value of the antenna, but it does improve the stability of this value. Furthermore, the invention enables an improvement in the antenna's cross-polarization parameters, whereas the prior art only describes vertical-polarization antennas.

Furthermore, it must be noted that the insulating value is not in any way influences by the presence of choke reflectors, as they are placed too far away from the radiating elements.

In one embodiment of the invention, the second reflective means is a metal sheet folded into a U shape, with the outer surface of one of the arms of the U cooperating with the outer surface of a folded edge of the first reflective means.

In one variant, the arms of the U are unequal in length.

In another variant, the metal sheet is made of aluminum.

According to one aspect of the invention, the second reflective means is disposed upon at least one part of the antenna's entire length. The choke reflector is applied against the outer surface of the folded edges of the first reflective means, on certain portions of the length of the first reflective means. The choke reflector may also cover the entire length of the first reflective means.

BRIEF DESCRIPTION OF THE DRAWINGS

Other characteristics and advantages of the invention will become apparent while reading the following description of embodiments, which are non-limiting and given for purely illustrative purposes, and in the attached drawing, in which.

DETAILED DESCRIPTION OF THE PREFERRED EMBODIMENTS

Figure 1:
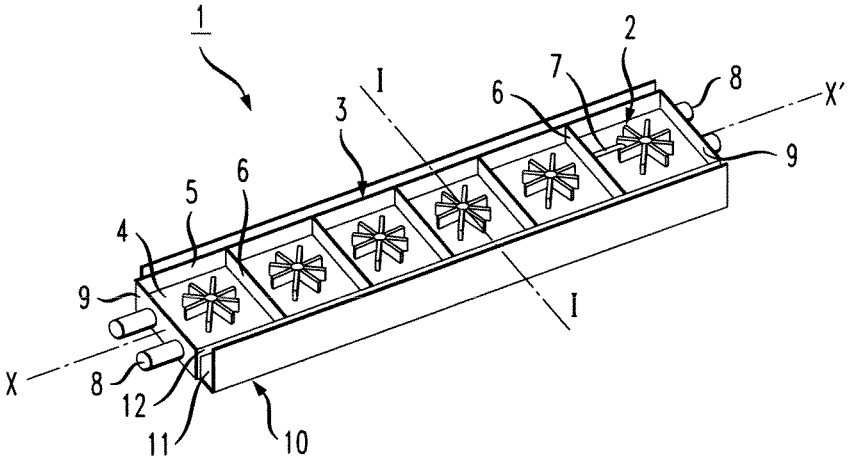
FIG. 1 represents a perspective view of an antenna with an array of radiating elements equipped with choke reflectors according to one embodiment of the invention along its entire length.

FIG. 1 depicts a single-band dual polarization antenna according to one embodiment of the present invention. The antenna 1 comprises elements 2, such as dipoles, radiating a radio frequency signal, arrayed along a main longitudinal axis X-X'. The antenna 1 also comprises a grounded reflective means 3, made up of a flat part 4 and lateral upward-folded edges 5, parallel to the axis X-X' of each side of the array of radiating elements 2. The radiating elements 2 are attached to the flat part 4 of the reflector 3. Transversal barriers 6 separate the radiating elements 2, and are supported by the lateral edges 5 of the reflector 3. The radiating elements 2 are electrically powered by lines 7 connected to connectors 8 supported by the extreme transversal barriers 9. The antenna 1 further comprises a feed network for 2 (not depicted) for feeding the radiating elements.

The antenna 1 comprises choke reflectors 10 made up of aluminum sheets folded into a U shape and placed longitudinally outside the reflector 3, out of the area near the radiating elements 2.

Figure 2A:
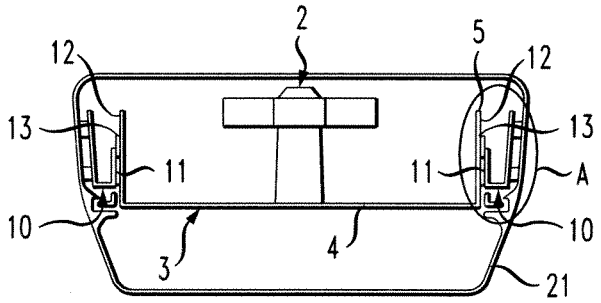
FIG. 2 is a transversal cross-section I-I of the antenna of FIG. 1.
FIG. 2*b* is an enlargement of the profile-view of section A of FIG. 2*a*.
Figure 2B:
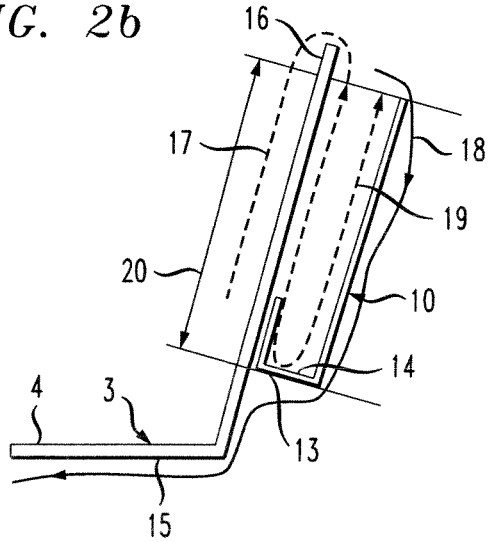

The outer surface 11 of one of the arms of the U is affixed to the outer surface 12 of the lateral edge 5 of the reflector 3, as shown in FIGS. 2*a* and 2*b*.

The arm of the U of the choke reflector 10 is separated from the lateral edge 5 of the reflector 3 to which it is affixed by a layer 13 of dielectric material. The capacitive coupling, equivalent to a short-circuit for the radio frequencies, which is created between the lower part 14 of the choke reflector 10 and the lower angle 15 of the reflector 3 leads to an open circuit in the upper edge 16 of the reflector 3. As a result, the currents 17 become trapped within the choke reflector 10, and no longer propagate in an uncontrolled manner (arrow 18) outside and inside the lower flat part 4 in the rear of the reflector 3, as illustrated in FIG. 2*b*. The line 19, whose flattened length is about one half wavelength, is a quarter wave transformer made up of two conductors facing one another, respectively the interior of the choke 10 and the exterior of the reflector 3. The other arm of the U of the choke 10, which is not affixed to the reflector 3, has a length 20 of about one quarter of a wavelength, in this case.

The radiating elements 2 are further protected by a casing 21.

Figure 3:
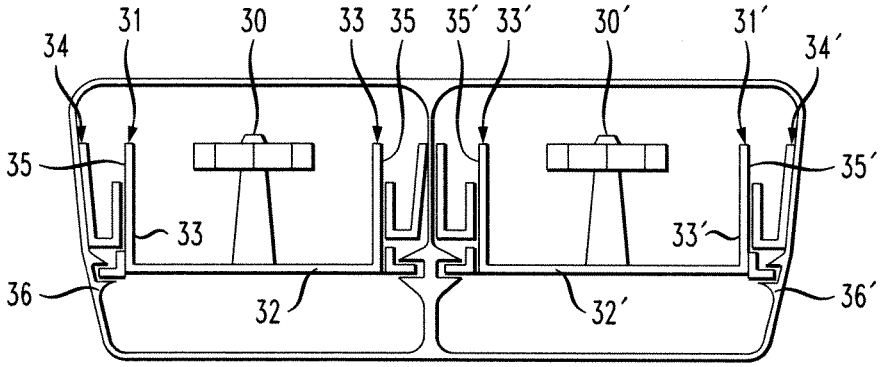
FIG. 3 is a transversal cross-section, analogous to FIG. 2*a*, of a variant embodiment of the invention, with two arrays of radiating elements disposed side-by-side.

In the event that two arrays of radiating elements 30 are disposed side-by-side, as depicted in FIG. 3, each array possesses a reflector 31, 31' made up of a flat base 32, 32' equipped with a folded flat base 33, 33' surrounding each array of radiating elements 30. Chokes 34, 34' are affixed to the outer surfaces 35, 35' of the edges 33, 33' of each of the reflectors 31, 31'. In this manner, each array of radiating elements 30 possesses its own reflector 31, 31' surrounded by two chokes 34, 34'. The two arrays of radiating elements 30 are further protected by a shared casing 36.

Figure 4:
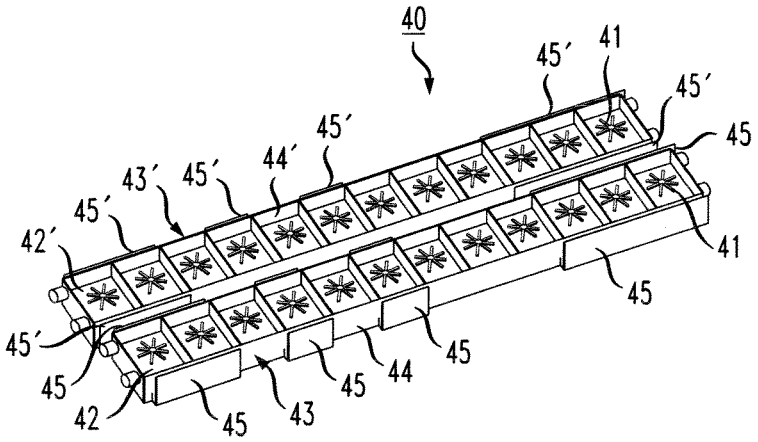
FIG. 4 represents a perspective view of an antenna with two arrays of radiating elements equipped with choke reflectors along one portion of its length, according to one embodiment of the invention.

In a perspective view, FIG. 4 depicts an antenna 40 comprising two arrays of radiating elements 41 fastened on the flat part 42, 42' of their respective reflectors 43, 43', comprising folded longitudinal edges 44, 44'. Chokes 45, 45' are disposed on the outside of the folded edges 44, 44' on a portion of the length of the antenna 40 only.

Figure 5:
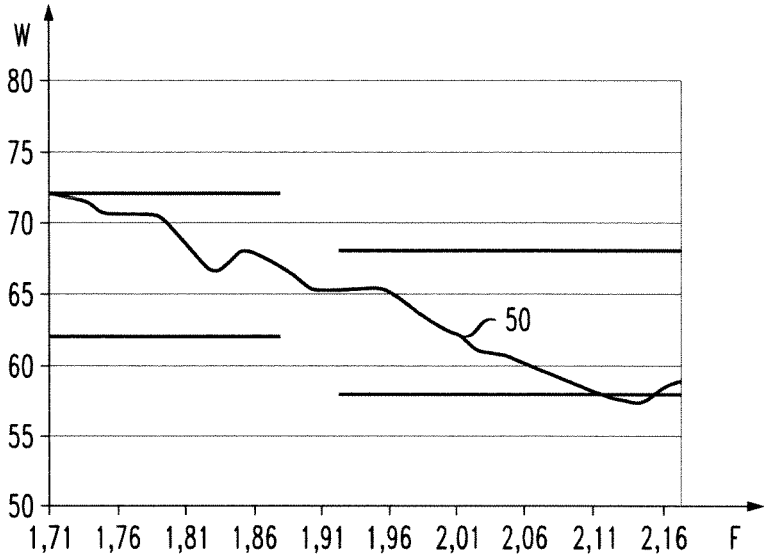
FIG. 5 shows the change in beam width W in degrees as a function of the frequency F in GHz for an antenna in accordance with the prior art.

A dual polarization antenna has two ports denoted +45° and −45°, which correspond to the two connectors of the antenna. FIG. 5 shows the change in beam width W at −3 dB for an antenna in accordance with the prior art for one of the two −45° (curve 50).

Figure 6:
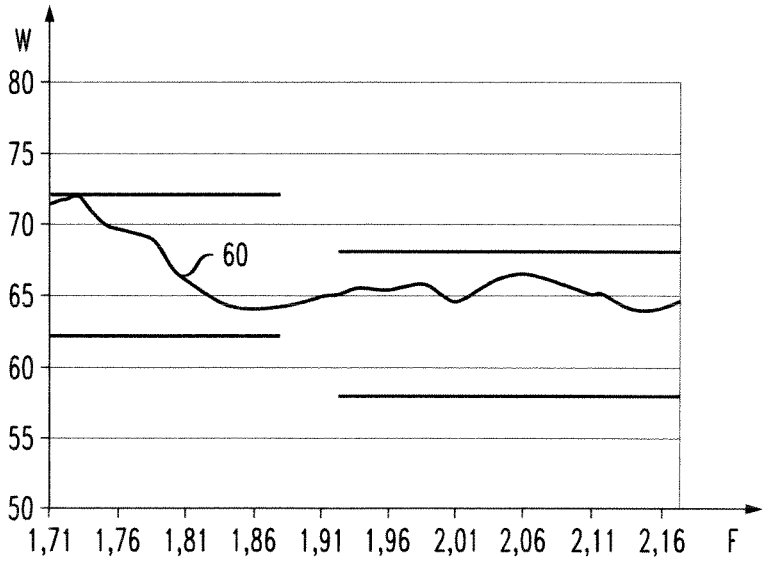
FIG. 6 shows the change in beam width W in degrees as a function of the frequency F in GHz for an antenna in accordance with one embodiment of the invention.

FIG. 6 shows the change in beam width W at −3 dB for an antenna comprising two choke reflectors in accordance with an embodiment of the invention for one of the two ports denoted −45° (curve 60).

Comparing the curves of FIGS. 5 and 6 shows that the antenna beam width W at −3 dB is between 57° and 73° (ΔW=16°) without choke reflectors, and that this width W is between 63.5° and 72° (ΔW=8.5°) when using choke reflectors in accordance with one embodiment of the present invention.

Figure 7:
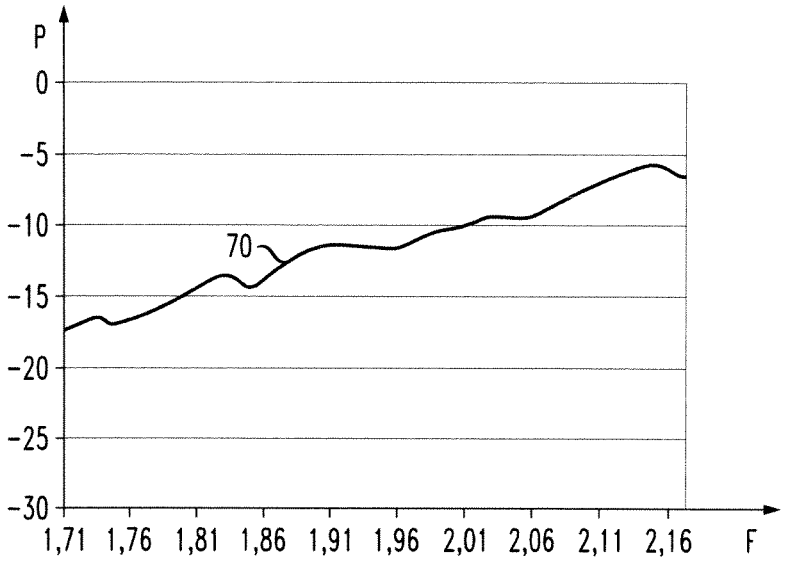
FIG. 7 shows the change in the cross-polarization P in dB in the sector +/−60° from the main axis as a function of the frequency F in Ghz for an antenna in accordance with the prior art.

FIG. 7 shows the change in cross-polarization P of an antenna of the prior art within the sector +/−60° from the main axis of the antenna for one of the ports denoted −45° (curve 70).

Figure 8:
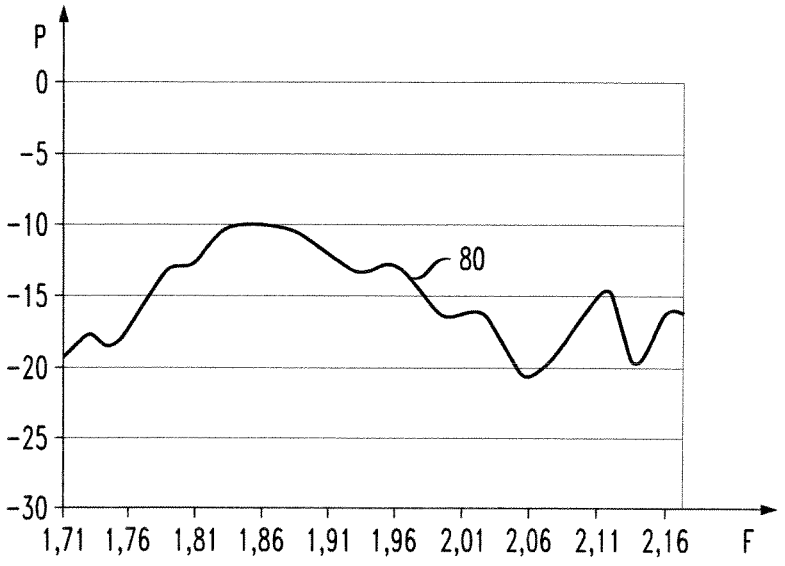
FIG. 8 shows the change in the cross-polarization P in dB in the sector +/−60° from the main axis as a function of the frequency F in Ghz for an antenna in accordance with one embodiment of the invention.

FIG. 8 shows the change in cross-polarization P of an antenna comprising two choke reflectors in accordance with one embodiment of the invention within the sector +/−60° from the main axis of the antenna for one of the two ports denoted −45° (curve 80).

Comparing the curves of FIGS. 7 and 8 shows that the cross-polarization level in a sector +/−60° from the axis of the antenna is better than −5.5 dB without choke reflectors, and that it is better than −10 dB when using the choke reflectors in accordance with one embodiment of the present invention.

There is claimed:

1. An antenna comprising a network of arrayed radiating elements, a first reflector comprising a flat central part upon which are disposed the radiating elements and longitudinally folded edges on either side of the array of elements, and at least one second reflector, wherein the second reflector is a choke reflector disposed outside the space separating the radiating elements from the folded edge of the first reflector, and wherein the second reflector is U-shaped with two sidewalls, one of the sidewalls being separated from the first reflector by a layer of dielectric material between the second reflector and a surface of a longitudinal folded edge of the first reflector in order to connect it to the first reflector by way of capacitive coupling.

2. An antenna according to claim 1, wherein the second reflector is a metal sheet folded into a U shape, with the outer surface of one of the arms of said U cooperating with the outer surface of a folded edge of the first reflector.

3. An antenna according to claim 2, wherein the arms of the U are unequal in length.

4. An antenna according to claim 2, wherein the metal sheet is made of aluminum.

5. An antenna according to claim 1, wherein the second reflector means is disposed upon at least one part of the antenna's entire length.

* * * * *